US007287449B2

(12) United States Patent
Abel et al.

(10) Patent No.: US 7,287,449 B2
(45) Date of Patent: Oct. 30, 2007

(54) SCREWDRIVER WITH REMOVABLE ROD

(75) Inventors: Michael Abel, Radevormwald (DE); Andre Müller, Wuppertal (DE)

(73) Assignee: Wera Werk Hermann Werner GmbH & Co.KG, Wuppertal (DE)

( * ) Notice: Subject to any disclaimer, the term of this patent is extended or adjusted under 35 U.S.C. 154(b) by 134 days.

(21) Appl. No.: 10/522,661

(22) PCT Filed: Jul. 21, 2003

(86) PCT No.: PCT/EP03/07923

§ 371 (c)(1),
(2), (4) Date: Aug. 29, 2005

(87) PCT Pub. No.: WO2004/011198

PCT Pub. Date: Feb. 5, 2004

(65) Prior Publication Data

US 2006/0048613 A1 Mar. 9, 2006

(30) Foreign Application Priority Data

Jul. 5, 2002 (DE) ..... 102 33 866

(51) Int. Cl.
*B25B 23/16* (2006.01)

(52) U.S. Cl. ..... 81/177.2; 81/438; 279/906; 279/75; 279/80

(58) Field of Classification Search ..... 81/177.2, 81/438, 439; 279/79, 80, 22, 905, 30, 75, 279/906

See application file for complete search history.

(56) References Cited

U.S. PATENT DOCUMENTS

| | | | | |
|---|---|---|---|---|
| 2,963,930 | A * | 12/1960 | Clothier et al. | 81/177.2 |
| 3,306,639 | A * | 2/1967 | Lyon | 403/107 |
| 4,586,406 | A * | 5/1986 | Howard | 81/177.2 |
| 5,732,506 | A | 3/1998 | Ohtani et al. | |
| 5,934,846 | A * | 8/1999 | Ishii | 408/141 |
| 6,044,733 | A | 4/2000 | Liu | |
| 6,155,143 | A | 12/2000 | Wu | |
| 6,155,144 | A | 12/2000 | Lin | |
| 6,520,509 | B1 * | 2/2003 | Vasudeva et al. | 279/145 |

FOREIGN PATENT DOCUMENTS

| | | |
|---|---|---|
| CH | 171 101 | 8/1934 |
| DE | 85 02 308 | 4/1985 |
| DE | G 90 00 245.8 | 1/1990 |
| DE | G 90 02 085.5 | 2/1990 |
| DE | 44 01 335 | 1/1994 |
| DE | 296 19 529 | 1/1997 |
| DE | 201 06 986 | 4/2001 |

* cited by examiner

*Primary Examiner*—D. S. Meislin
(74) *Attorney, Agent, or Firm*—Martin A. Farber

(57) ABSTRACT

Screwing tool (1) having a grip (2) and a shank (3), which is received removably in a cavity (4) open toward an end of the grip (2) and which at its free end has an actuating portion (5). The shank (3) is retained in a position of use such that it is fixed in terms of rotation on the grip, to avoid sliding in the axial direction, by a retaining element (14) associated with the grip (2). The retaining element (14) can be displaced into a removal position by displacement of an actuating member (6) in order for the shank to be removed from the grip (2). In a storage position, a large part of the shank (3) is located in the cavity (4), where it is held by a holding element (H). The holding element (H) is releasable, so that part of the shank (3) can be moved out.

24 Claims, 13 Drawing Sheets

SCREWDRIVER WITH REMOVABLE ROD

FIELD AND BACKGROUND OF THE INVENTION

The invention relates to a screwing tool having a grip and a shank which is received removably by a chuck associated with the grip and at its free end has an actuating portion.

Screwing tools of this type are known from the prior art. Screwing tools of this type usually have exchangeable blades. The grip has a central cavity, into which a clamping portion of the blade can be slid. There, on the side of the cavity opening, it is possible to provide a clamping chuck which has clamping jaws that can be moved radially onto the blade in order to hold the blade retained in the axial direction. The blade can be used with different lengths by means of a chuck of this type. Although this solution has the advantage of a stepless length adjustment, if the clamping jaws are not pressed onto the shank with sufficient force, the shank can slip into the grip in the event of a corresponding axial load being applied to the grip.

Furthermore, the prior art has disclosed clamping chucks for holding bits. Clamping chucks for bits are shown, for example, in DE-U1 85 02 308, DE-U1 201 06 986.5 and DE-U1 90 00 245.8.

Screwdrivers with exchangeable blades are known from DE 44 01 335 C2 and DE-U1 90 02 085.

SUMMARY OF THE INVENTION

The invention is based on the object of further developing the screwing tool of the generic type in a way which is advantageous for use.

The object is achieved by the invention given in the claims.

The invention provides firstly and substantially that the removable shank can also be moved into a storage position, in which a large part of the shank is located in a rear part of the cavity, where it is held by means of holding means, which holding means are releasable, so that that part of the shank which is located within the cavity, apart from a holding portion of the shank associated with the fixed end of the shank, can be moved out of the cavity into a position of use onto a stop by the application of force, in which position of use the holding portion is retained in the axial direction and in the direction of rotation by the chuck. This retaining can be released in order shank can be displaced outward with respect to the grip by the compression spring, but before it has reached the release position of the blocking ball, which captures the shank on reaching its outwardly displaced position. This refinement has the advantage that the actuator initially only displaces the actuating sleeve sufficiently far for the shank to be the subject of preliminary displacement. The further displacement into the release position of the blocking ball has to be deliberate. It is particularly advantageous if the resistance is audibly overcome. For example, it is provided that the bush which defines the cavity for receiving the shank has an annular groove, in which a circlip is located. An inwardly directed collar of the actuating sleeve comes into contact with this circlip. This produces the perceptible resistance. The depth of the groove is such that the circlip can yield into it. Therefore, it has to be compressed if the collar is to be lifted over the circlip. Moreover, this is associated with an audible click. In a further configuration of the invention, it is provided that the actuating sleeve has a link guide. This link guide comprises a longitudinal slot in which a guide pin engages. The longitudinal slot has an obtuse-angled extension into which the guide pin engages when the actuating sleeve is rotated. Rotation of the actuating sleeve is required in order to release the blocking ball.

The invention of the latching mechanism is of stand-alone inventive importance even independently of the removability of the shank which was primarily outlined above.

The shank is rotationally fixedly connected to the grip in the position of use. In the storage position, rotationally fixed connection with respect to the shank is not required.

BRIEF DESCRIPTION OF THE DRAWINGS

Exemplary embodiments of the invention are explained below with reference to the drawings, in which.

DETAILED DESCRIPTION OF THE PREFERRED EMBODIMENT

Figure 1:
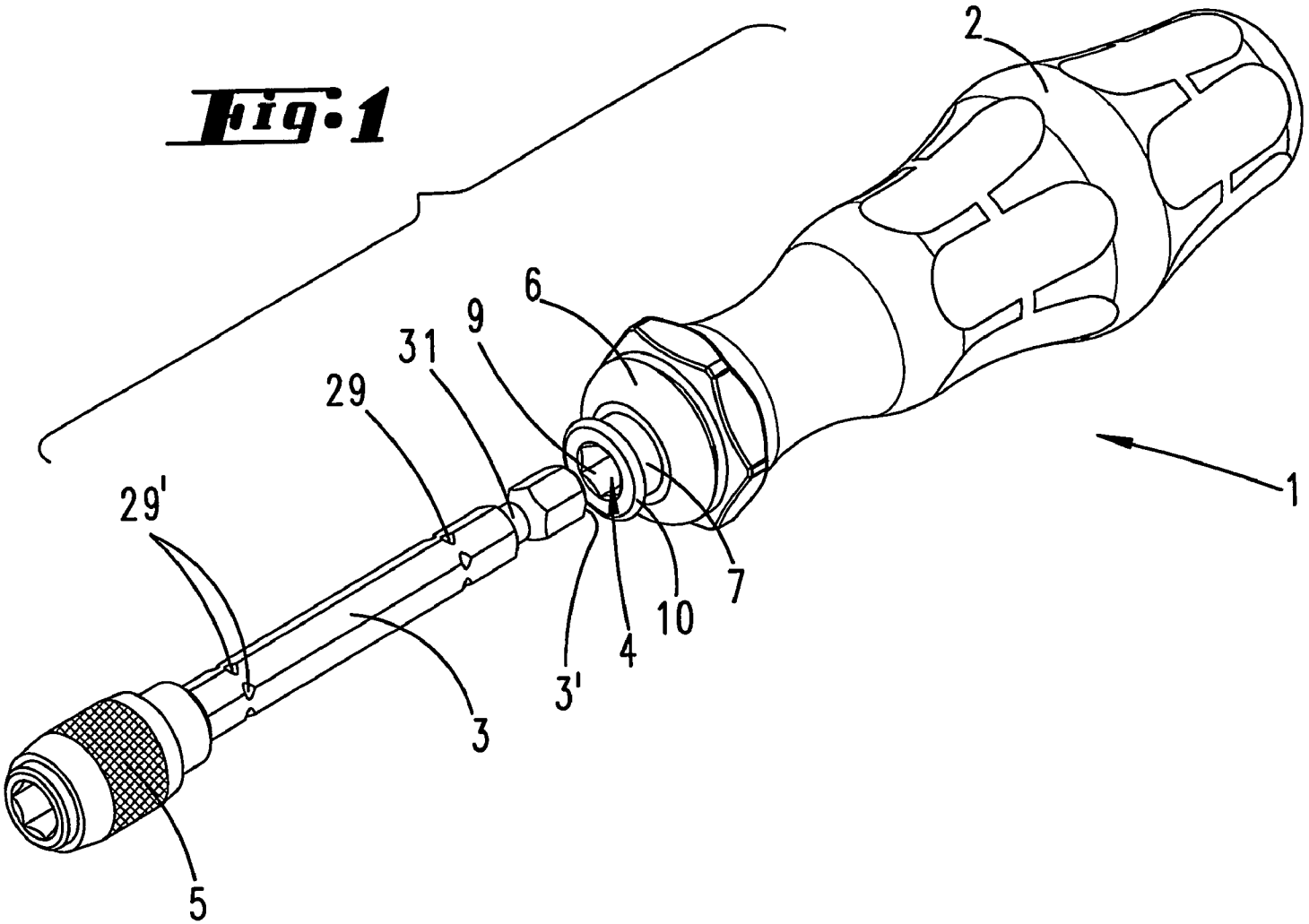
FIG. 1 shows a perspective illustration of the grip of the screwing tool with associable shank.
Figure 4:
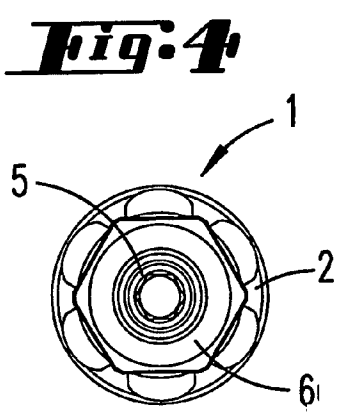
FIG. 4 shows a rear view of FIG. 2 rotated through 90°.
Figure 2:
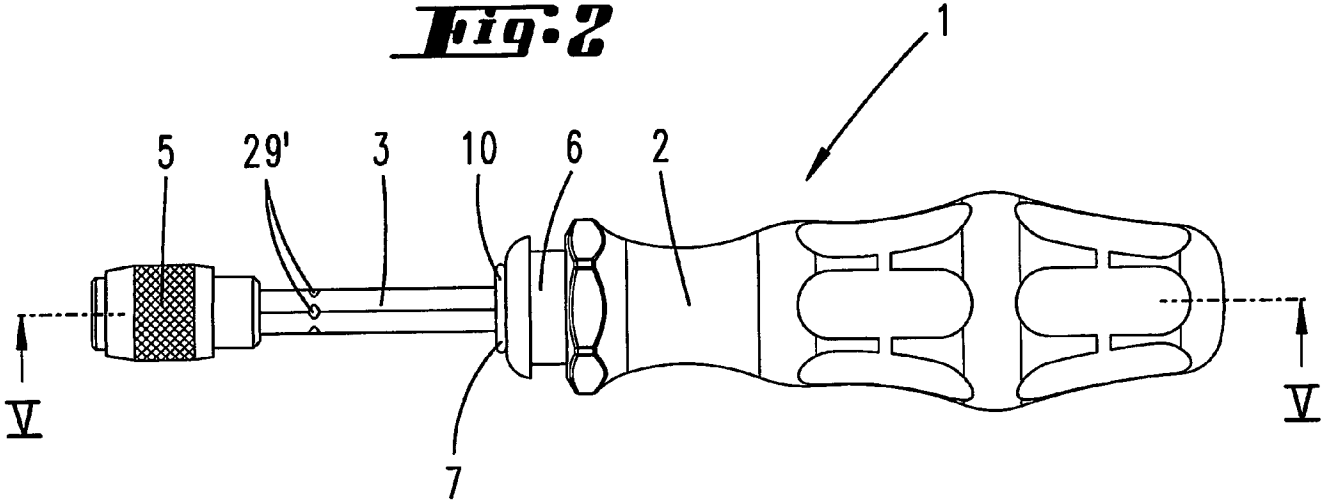
FIG. 2 shows a view toward the screwing tool in a position of use.
Figure 3:
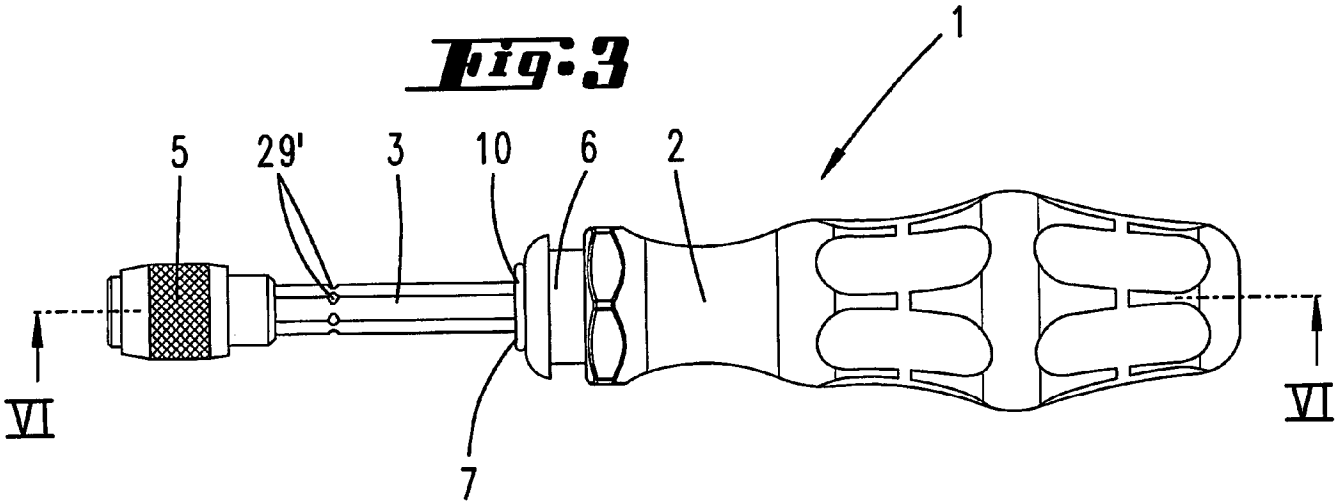
FIG. 3 shows a view corresponding to FIG. 2 rotated through 90°.

Reference numeral 1 denotes a screwing tool which is composed of a grip 2 and a polygonal shank 3. The hexagonal shank 3 can be fitted into an axially disposed cavity 4 in the grip 2. The free end of the polygonal shank 3 has an actuating portion in the form of a clamping chuck 5. An axially displaceable actuating sleeve 6 is associated with the grip 2 to the rear of the opening of the cavity 4. Furthermore, the grip 2 is in the shape and form of a screwdriver handle.

Figure 11:
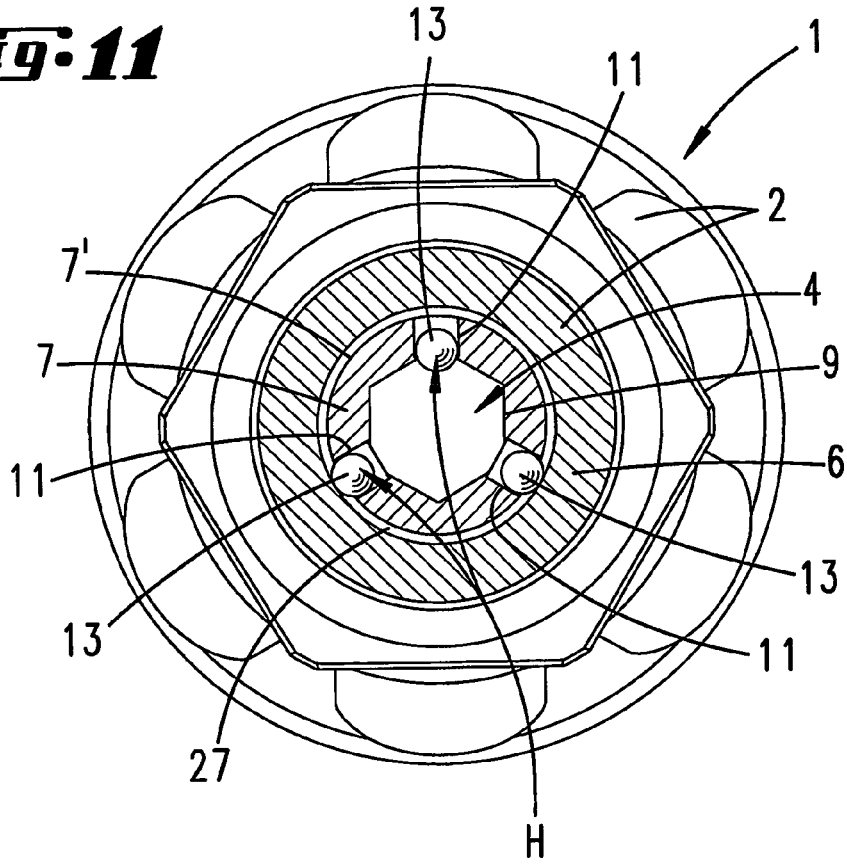
FIG. 11 shows a sectional view on line XI-XI in FIG. 5.
Figure 12:
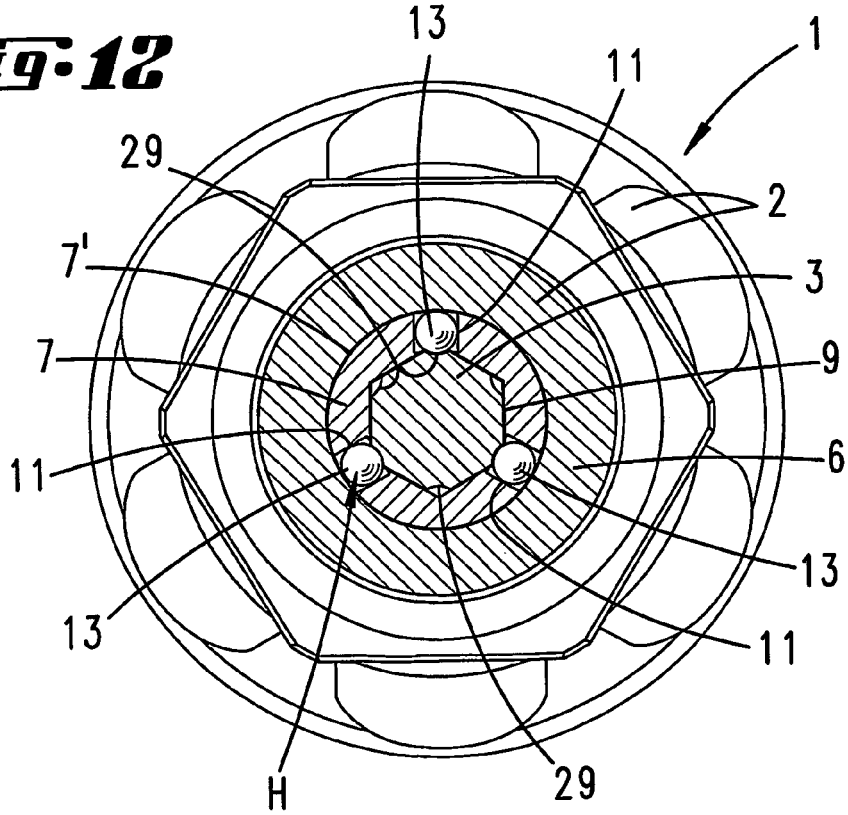
FIG. 12 shows a sectional view on line XII-XII in FIG. 7.
Figure 13:
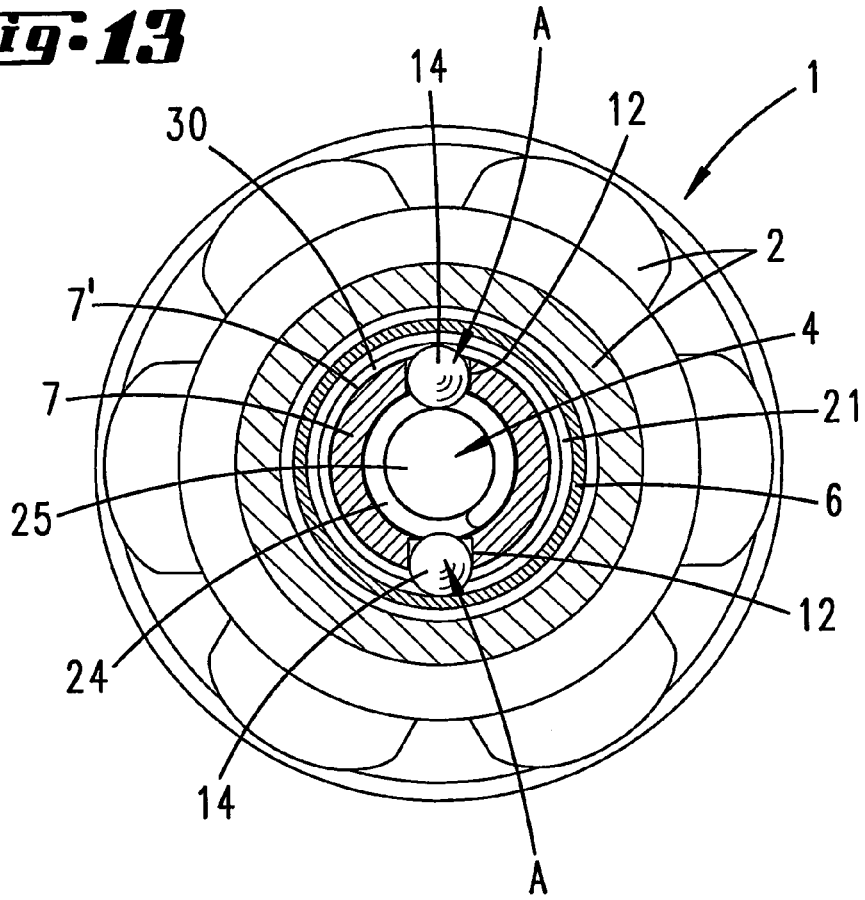
FIG. 13 shows a sectional view on line XIII-XIII in FIG. 6.
Figure 14:
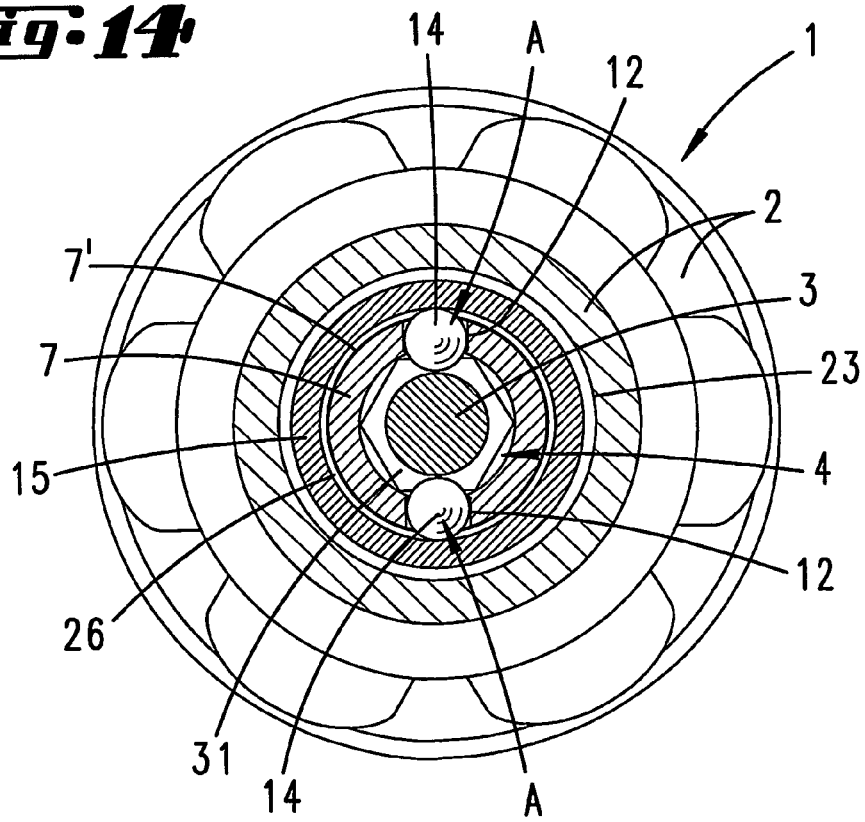
FIG. 14 shows a sectional view on line XIV-XIV in FIG. 8.
Figure 15:
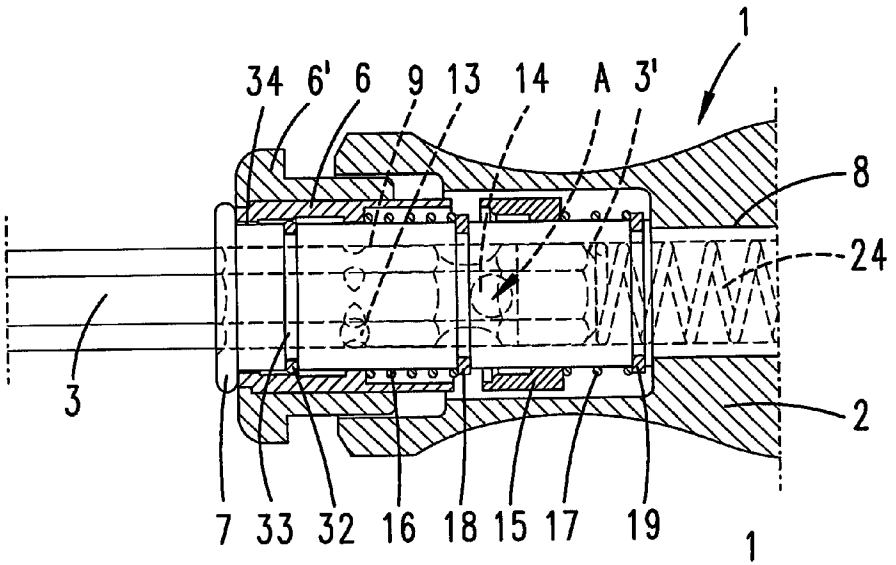
FIG. 15 shows a sectional illustration of a further exemplary embodiment of the invention in the region of the chuck with locked actuating sleeve.
Figure 16:
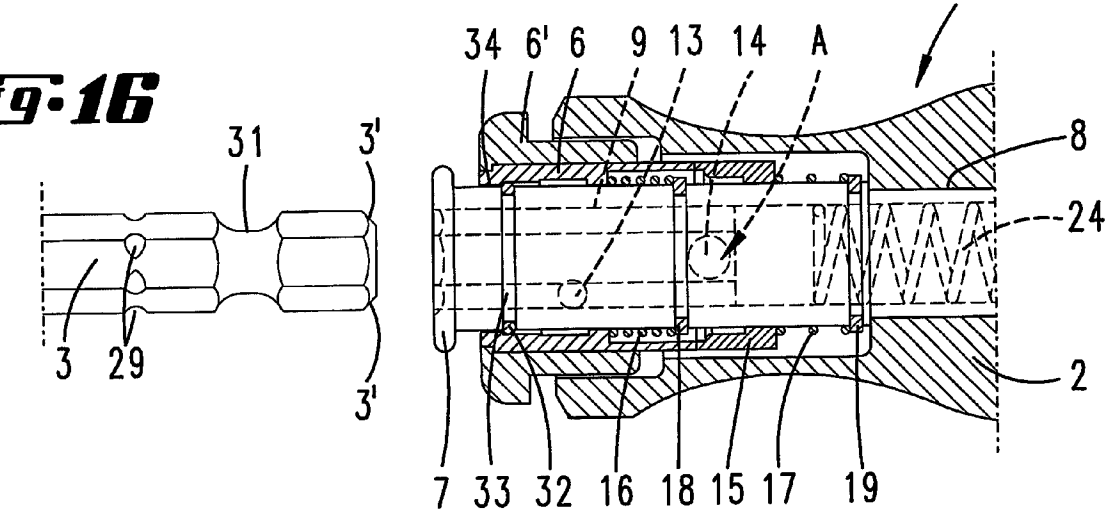
FIG. 16 shows the exemplary embodiment in accordance with FIG. 15, with the actuating sleeve 6 having been displaced into the release position of the latching ball 13.
Figure 17:
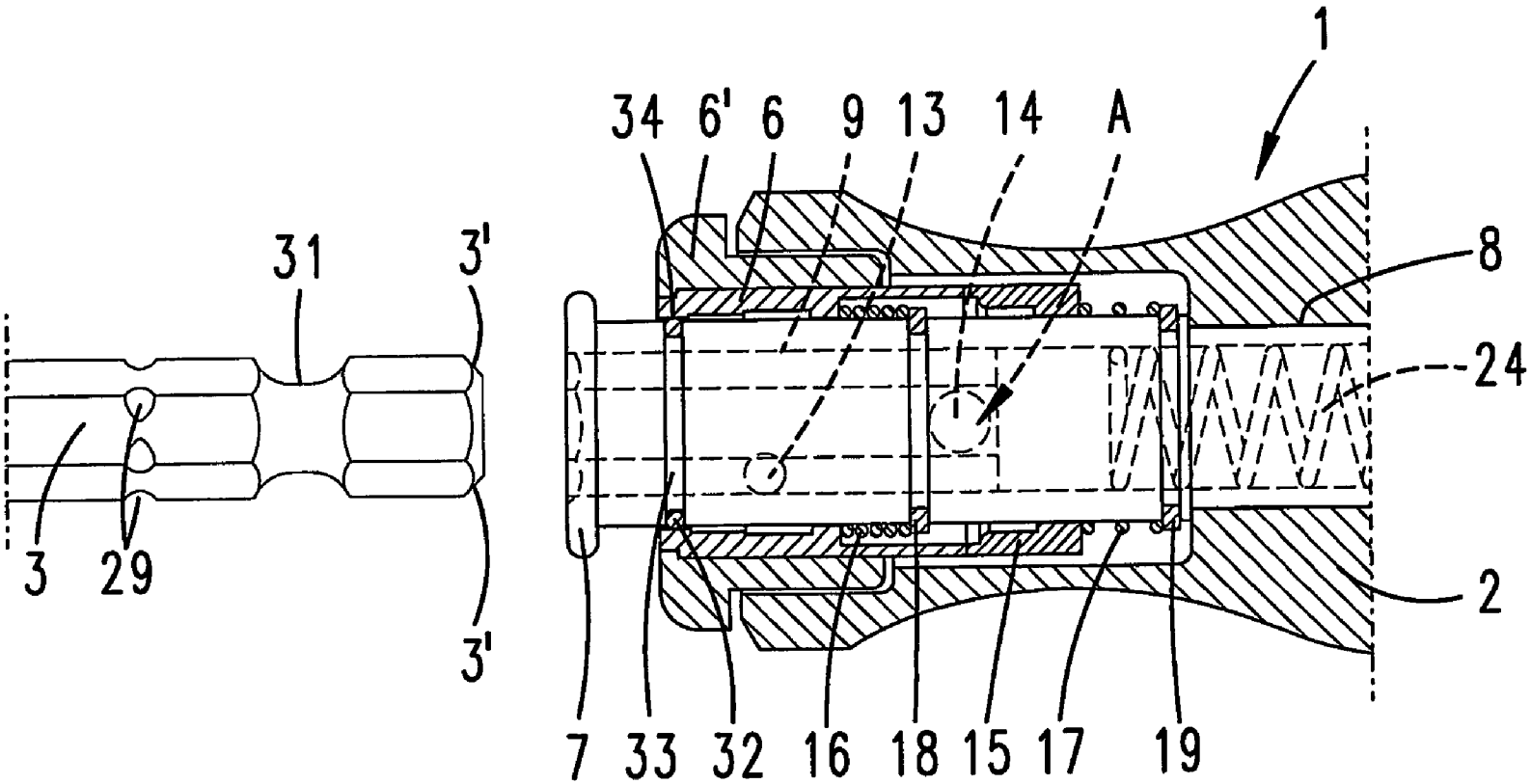
FIG. 17 shows the exemplary embodiment in accordance with FIG. 15, with the actuating sleeve having been displaced into the release position of the blocking ball.

The grip cavity 4 which has already been mentioned above is formed by a tube 7 which receives the shank 3. Approximately half of the body length of the tube 7 is seated in a rotationally fixed manner in an axially disposed opening 8 in the grip 2, the opening 8 extending further toward the inside of the grip. In the insertion region, the cavity 4 is in part shaped as a polygonal cavity 9. Furthermore, at its free end which projects beyond the grip 2, the tube 7 has an engagement shoulder 10 of larger diameter. Furthermore, the tube 7 has window-like apertures 11 and 12 which have been formed in the radial direction and are located axially offset, with three windows 11 located in a first plane being disposed at an angle of 120° with respect to one another and the two windows 12 located in the second plane, which is offset toward the rear, being disposed diametrically opposite one another. Latching balls 13 are disposed in the windows 11 such that they are retained in terms of movement, and blocking balls 14 are disposed in the windows 12 such that they are retained in terms of movement. Furthermore, the diameters of the latching balls 13 are smaller than the diameters of the blocking balls 14 (cf. in particular the illustrations in FIGS. 11 and 13).

Beyond the stop shoulder 10, i.e. directed toward the inside of the grip, the axially slidable actuating sleeve 6 slides on a portion 7' of wider diameter of the tube 7. A locking sleeve 15 is associated with the actuating sleeve 6 to the rear. The same locking sleeve 15 likewise slides on the portion 7' of larger diameter of the tube 7. Both the actuating sleeve 6 and the locking sleeve 15 are spring-loaded outward in the axial direction by springs 16 and 17. In this context, spring 16 is associated with the actuating sleeve 6 and spring 17 is associated with the actuating sleeve 15. Both springs 16 and 17 are likewise disposed in axially oriented manner on the portion 7' of the tube 7. Two annular collars 18 and 19 serve as the necessary abutment for the springs 16 and 17, the annular collars 18 and 19 each being located radially in circumferential grooves of the tube 7. In this context, the annular collar 18 is associated with the spring 16 and the annular collar 19 is associated with the spring 17. While one side of the spring 17 is supported on the end face 15' of the locking sleeve 15, the spring 16 has an annular portion 20 of the actuating sleeve 6 engaging over it, which annular portion 20 defines a cavity 21, one side of the spring 16 being supported on the base of the cavity 21.

Furthermore, it is provided that the latching balls 13 interact with the actuating sleeve 6 and the blocking balls 14 interact with the locking sleeve 15.

Whereas the actuating sleeve 6 is only partly engaged over by the grip 2, which has an opening 22 which at the end is matched to the diameter of the actuating sleeve 6 in order to ensure axial slidability, the locking sleeve 15 is completely received in an axial opening 23 which is made in the base of the opening 22 and is of reduced diameter compared to the opening 22. In this context, the spring 16 and the annular collar 18 are associated with the opening 22 and the spring 17 and the annular collar 19 are associated with the opening 23 of the grip 2.

The positioning of the latching balls 13 and of the blocking balls 14 is such that the latching balls 13 are located in that portion of the tube 7 which projects beyond the grip 2 and the blocking balls 14 are located in that portion of the tube 7 which the grip 2 engages over, in the region of the step between the openings 22 and 23.

The opening 8 which is formed in the axial direction and has already been mentioned above opens into the base of the opening 23. One side of a spring 24 may be adhesively bonded or injection-molded to the base of the opening 8. Furthermore, the spring 24 is wound around a peg 25 of the grip 2, which peg 25 is identical in terms of materials to the grip 2. The free end of the spring 24 penetrates into the cavity 4. The spring 24 is guided by the inner wall 4 of the tube 7. The diameter of the spring 24 is slightly smaller than the diameter of the cavity 4.

Figure 5:
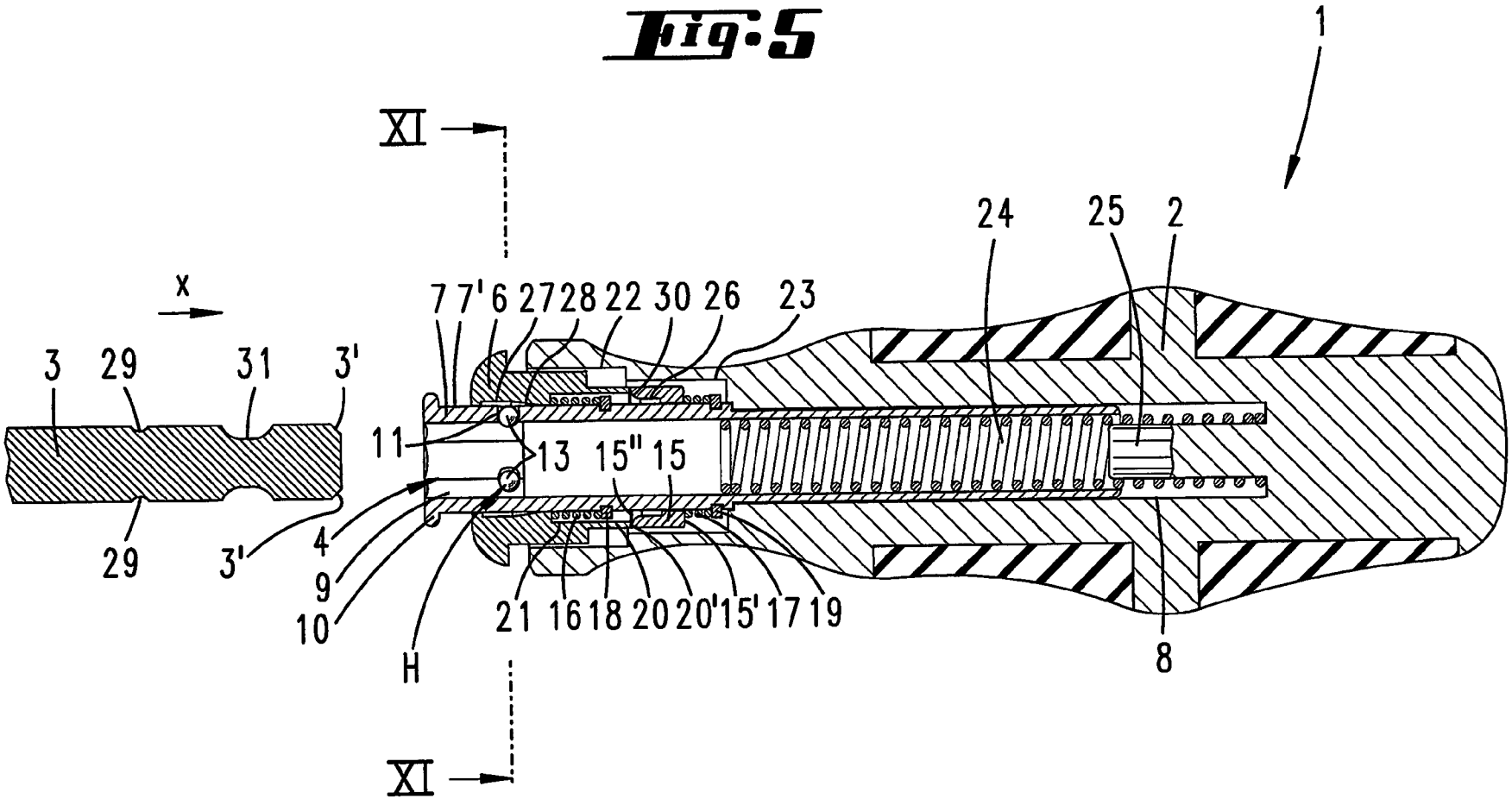
FIG. 5 shows a section on line V-V in FIG. 2, but in a released position of the shank.
Figure 6:
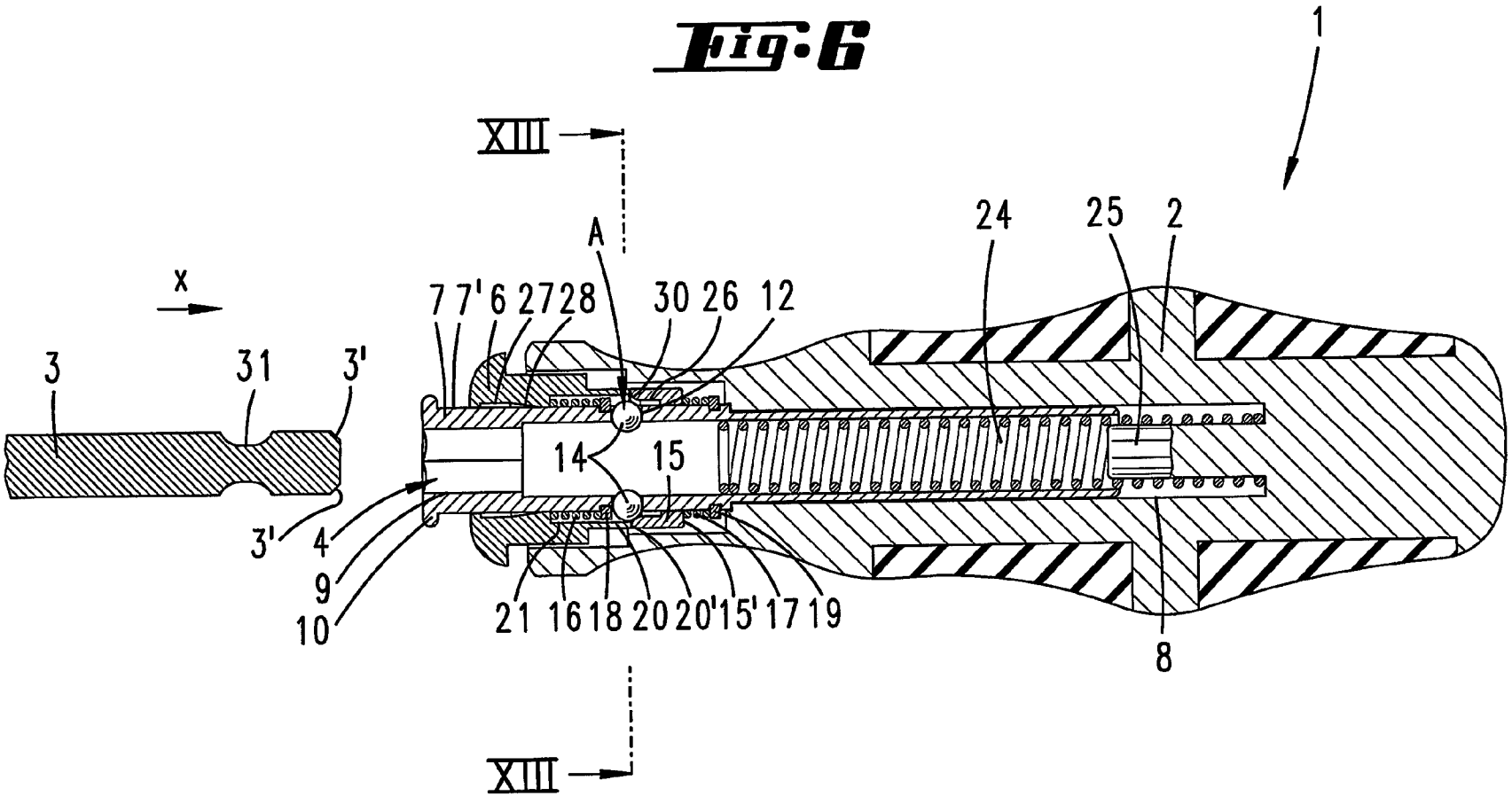
FIG. 6 shows the section on line VI-VI in FIG. 3, but relating to the position illustrated in FIG. 5.

The mode of action will now be explained in more detail with reference to the illustrations in FIGS. 5 and 6:

To move the screwing tool 1 into a position of use, the actuating sleeve 6 has to be displaced inward with respect to the grip counter to the spring force of the spring 16. This is associated with the end face 20' of the annular portion 20 of the actuating sleeve 6 acting on the end face 15" of the locking sleeve 15, causing the same locking sleeve 15 to move inward with respect to the grip counter to the spring force of the spring 17.

This displacement of the actuating sleeve 6 and of the locking sleeve 15 into a release position means that the latching balls 13 and the blocking balls 14 are now in a position to move radially outward. In the process, the latching balls 13 partially pass through the windows 11 in the tube 7 and then, in segmented fashion, enter a cavity 27 in the actuating sleeve 6. The blocking balls 14 likewise move partially through the windows 12 in the tube 7 and then in segmented fashion enter the cavity 21 in the annular portion 20 of the actuating sleeve 6. Depending on the position of the screwing tool 1, the latching balls 13 and the blocking balls 14 can move radially outward of their own accord in this situation as illustrated.

Figure 7:
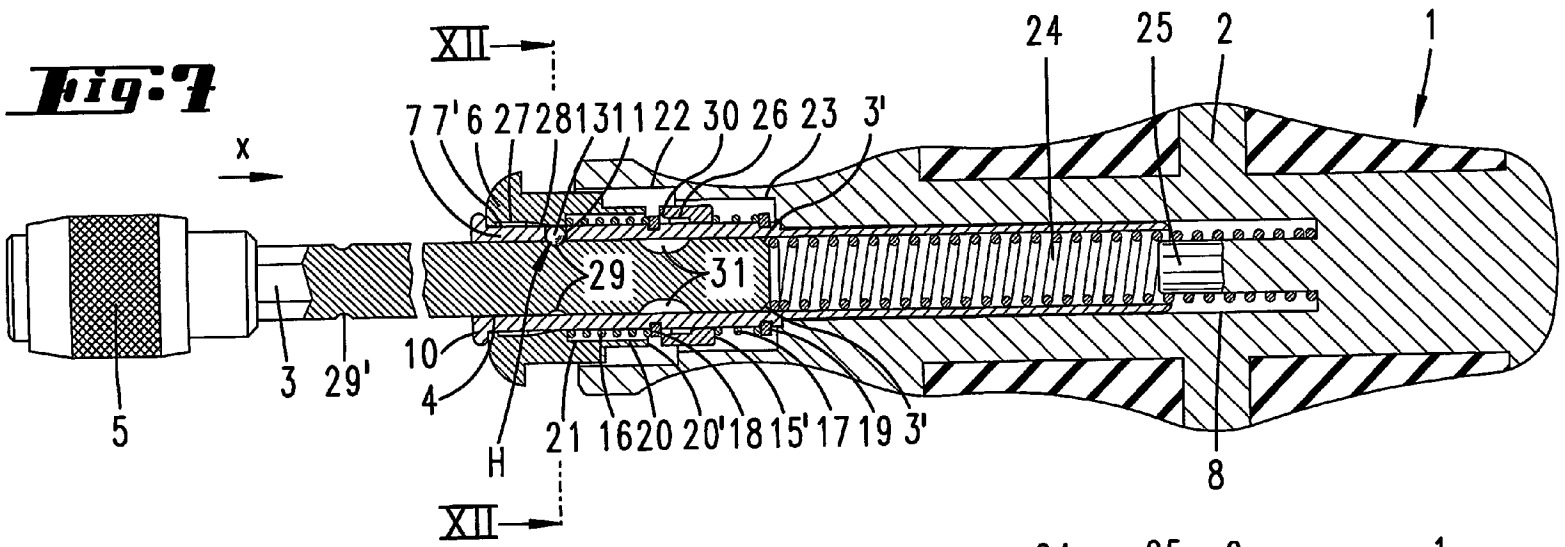
FIG. 7 shows the follow-up illustration to FIG. 5, but in a position of use of the shank.
Figure 8:
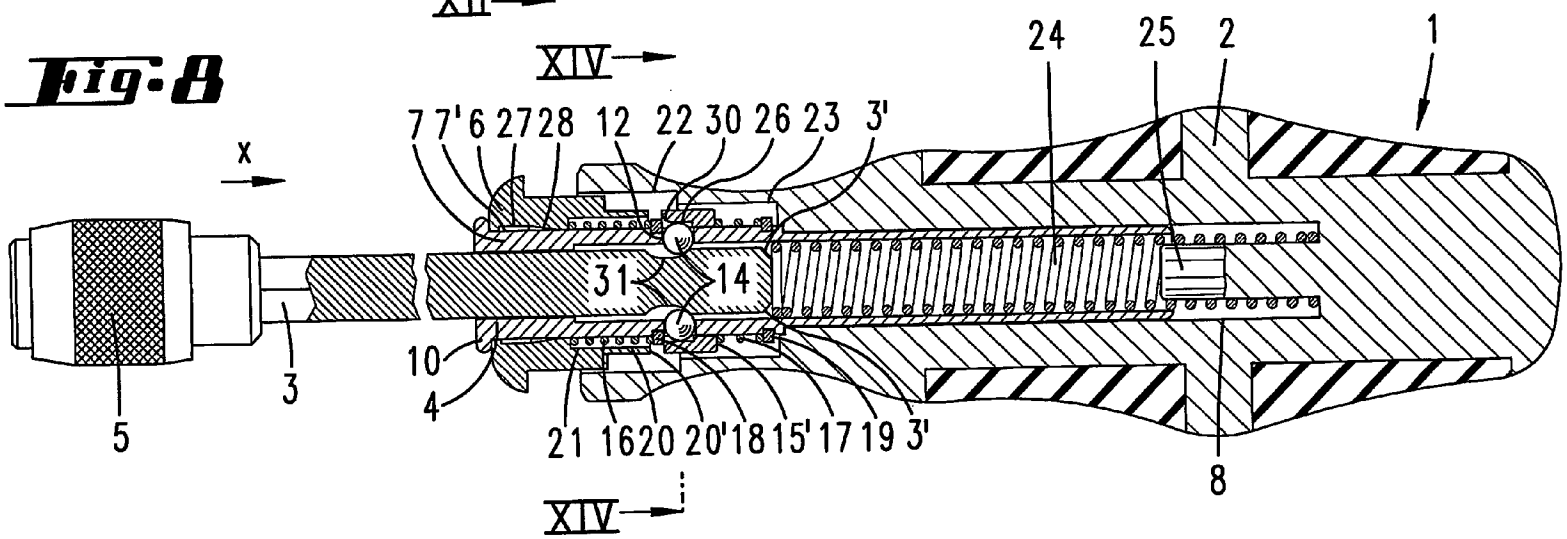
FIG. 8 shows a follow-up illustration to FIG. 6, but in the position of use.

To produce a locking position of the screwing tool, the situation as illustrated in FIGS. 7 and 8 is established. For this purpose, the shank 3 has to be fitted into the cavity 4 in the insertion direction x through the polygonal cavity 9. This is associated with a radially outward displacement by the run-up slope 3' of the shank 3 of both the latching balls 13 and the blocking balls 14. As the shank 3 slides in further, the latching balls 13 and the blocking balls 14 move with it on the outer lateral surface of the shank 3. The shank 3 is introduced into the cavity 4 until the blocking balls 14 move into the annular neck 31.

After the actuating sleeve 6 has been released, both the actuating sleeve 6 and the locking sleeve 15 are displaced outward with respect to the grip by the prestressed springs 16 and 17, the outward displacement of the actuating sleeve 6 being limited by the stop shoulder 10. The annular collar 18 prevents further axially outward displacement of the locking sleeve 15, with the end face 15" of the locking sleeve 15 acting on the underside of the annular collar 18.

The following occurs during the axially outward displacement of the actuating sleeve 6 and of the locking sleeve 15:

By means of an axially oriented oblique flank 28, the actuating sleeve 6 acts on the latching balls 13 and causes them to partially pass through the windows 11 in the tube 7 and then to engage in corner cutouts 29 of the shank 3. In this context, the positioning of the corner cutouts 29 is selected in such a manner that they are disposed transversely with respect to the position in which the shank 3 extends. A radially oriented oblique boundary edge 30 of the locking sleeve 15 acts on the blocking balls 14 and causes them to partially pass through the windows 12 in the tube 7 in order then to engage in an annular neck 31 of the shank 3. In this context, the axial length of the annular neck 31 is greater than the diameter of the blocking balls. Therefore, the screwing tool 1 is located in a latch-secured position of use, with the latching balls 13 forming an axial securing feature for the shank 3 in the grip 2 (cf. in particular the illustrations in FIGS. 7 and 8). The blocking balls 14 are located in a positively locking manner beneath the cylindrical wall of the cavity 26.

Furthermore, the latching balls 13 perform the function of a holding means H. The blocking balls 14 perform the function of a stop A in order to define the insertion position of the shank 3 in the position of use.

With regard to the mode of operation of the holding means H, reference is made to DE-U1 90 00 245, in the name of the present Applicant. According to this, with the shank 3 inserted, each of the corner cutouts 29 is aligned with a latching ball 13, which through the released actuating sleeve 6 comes into two-point contact with the surfaces, which are in a prism-like relationship with respect to one another, of the corner cutouts 29.

Figure 9:
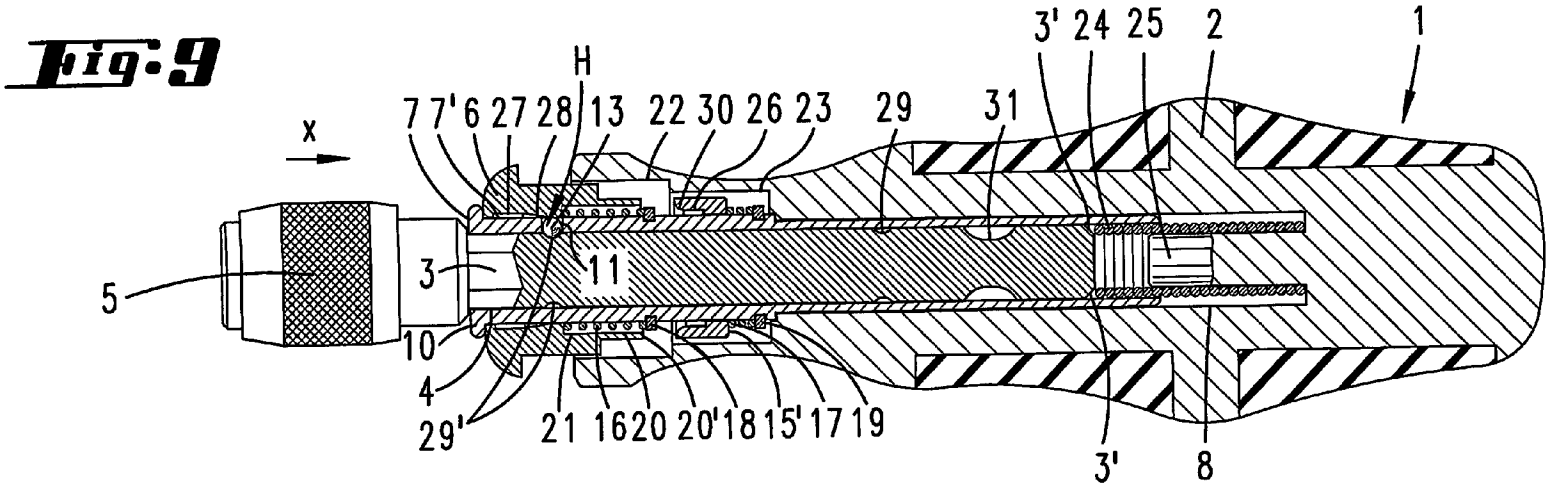
FIG. 9 shows a follow-up illustration to FIG. 7, but in a storage position of the shank.
Figure 10:
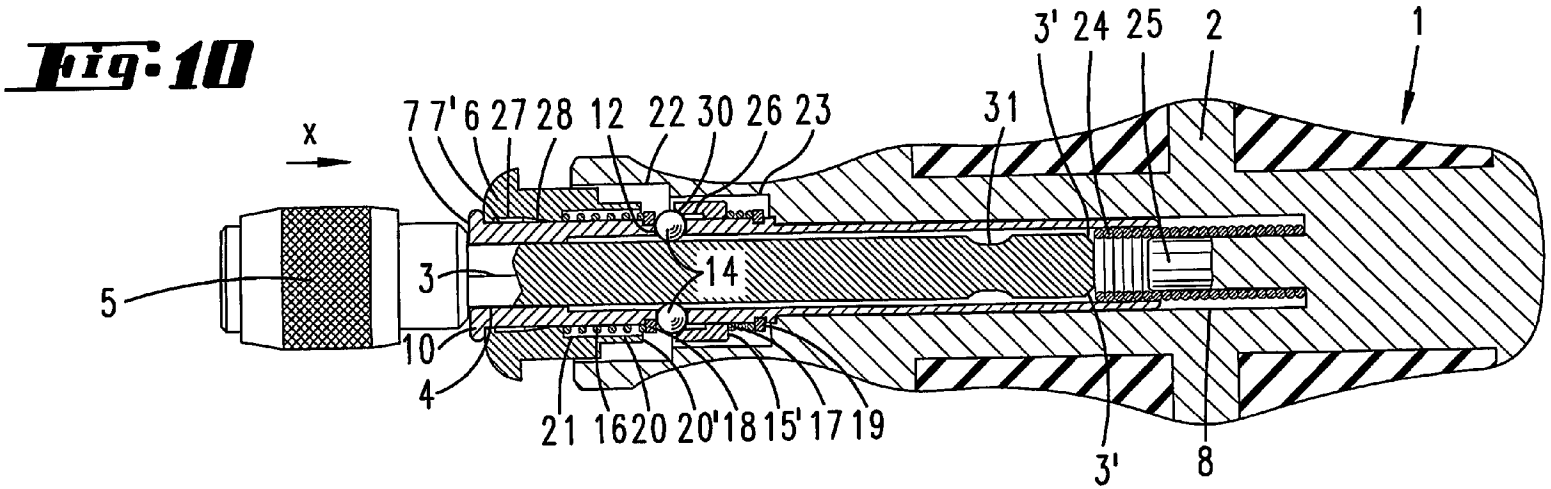
FIG. 10 shows a follow-up illustration to FIG. 8, but in the storage position.

As shown in the illustrations presented in FIGS. 9 and 10, it is also possible for the shank 3, which includes the clamping chuck 5, to be moved into a so-called storage position, i.e. for virtually the entire length of the shank 3 to be slid into the cavity 4 in the grip 2. For this purpose, the actuating sleeve 6 and the corresponding locking sleeve 15 have to be displaced inward with respect to the grip, so that the inclined flank 28 of the actuating sleeve 6 releases the latching balls 13. This is associated with the boundary edge 30 of the locking sleeve 15 releasing the blocking balls 14. If the shank 3 is then displaced further inward with respect to the grip, counter to the spring force of the spring 24, the latching balls 13 and the blocking balls 14 are also displaced radially outward as a result of this sliding-in motion. The blocking balls 14 are supported against the slopes 30. Since the blocking balls 14 cannot penetrate radially inward, but rather rest against the shank 3, the locking sleeve 15 remains in its rear position.

The axial spacing which can be seen in FIGS. 7 and 8 and in principle allows a certain preliminary displacement of the actuating sleeve 6 before it drags the locking sleeve 15 with it is greater in the storage position illustrated in FIGS. 9 and 10.

During further displacement of the shank 3 which includes the clamping chuck 5, the spring 24 is prestressed. To allow the shank to be held in this storage position inside the grip 2, the shank 3 has further axially offset corner cutouts 29', into which the latching balls 13 once again move in a blocking manner after the storage position has been reached. Releasing the actuating sleeve 6 secures this position, with only the latching balls 13 entering the corner cutouts 29 of the shank 3. The blocking balls 14 which form the stop A are only supported on the outer surfaces of the polygonal shank (cf. in particular the illustration in FIG. 10). In the storage position, the blocking ball 14 is pressed onto the shank by the oblique boundary edge 30 of the locking sleeve 15. This effects a certain frictional moment.

If, starting from the storage position illustrated in FIGS. 9 and 10, the actuating sleeve 6 is displaced slightly inward with respect to the grip, the cavity 27 moves over the latching balls 13, so that the latching balls 13 can move radially out of their associated corner cutouts 29'. In this intermediate position, the rear boundary edge 20' of the actuating sleeve 6 does not yet need to have come into contact with the boundary edge 30 of the locking sleeve 15. If the force of the spring 24 is greater than the above-described frictional force of the blocking ball 14 on the shank 3, the shank 3 is moved out of the cavity 8 solely by the force of the spring 24. The spring 17 which loads the locking sleeve 15 at the rear ensures that the blocking ball 14 can enter the annular neck 31 when the latter is located beneath the blocking ball 14. As a result, the outward movement of the shank 3 is stopped. When the actuating sleeve is released again, the latching ball 13 enters the corner cutout 29, so that the position of use illustrated in FIGS. 7 and 8 is reached.

Should the frictional force which the blocking ball 14 exerts on the shank 3 be greater than the force of the spring 24, which is not desired, the blocking ball 14 can nevertheless perform its stop function if the shank 3 is moved out of the cavity 4 under the force of gravity or by a pulling action on the clamping chuck 5.

If it is desired for the shank 3 which has the clamping chuck to be completely removed, the actuating sleeve 6 and the corresponding locking sleeve 15 have to be displaced inward with respect to the grip. This allows the spring 24 to exert its prestressed force, so that the shank 3 is displaced outward with respect to the grip. This is also associated with the latching balls 13 and the blocking balls 14 being displaced radially outward, so that they can in turn move into the cavities 27 in the actuating sleeve 6 and 21 in the annular portion 20. Consequently, the shank 3 which includes the clamping chuck can be separated from the grip 2 in order if appropriate for a shank 3 which has a different actuating portion to be fitted in.

It is considered particularly advantageous for the shank 3 at its end to have an annular neck 31 which is at a spacing from the end of the shank 3 such that the hexagonal shank can be fitted into a standard chuck of an electric screwdriver or the like. A chuck of this type may, for example, be configured as described in DE 199 32 369.0.

Therefore, the tool according to the invention is suitable for use with a power screwdriver and at the same time for being driven by a manually actuable grip. If it is used as a manual screwdriver, it has proven advantageous for the grip to perform the function of a storage chamber into which the shank can be fitted. By snapping the shank out of the cavity in the grip, it is possible to produce a practical screwdriver with a suitably long blade.

In the exemplary embodiments illustrated in FIGS. 15 to 21, the actuating sleeve 6 can initially be displaced into a release position for the latching ball 13. In this release position, the shank 3, which is located in the storage position, can undergo preliminary displacement into the position of use. This is effected by means of the compression spring 24. In this position, the blocking ball 15 is still subject to the action of its associated locking sleeve 15. Therefore, when the position of use is reached, the blocking ball 14 latches into its associated annular neck 31 of the shank 3.

In the two exemplary embodiments, this position of the actuating sleeve can only be passed by overcoming a resistance. In the exemplary embodiment illustrated in FIGS. 15 to 17, the resistance is provided by a radially inwardly directed collar 34 of the actuating sleeve 6, which butts against a radially protruding portion of a circlip 32 located in an annular groove 33. In this exemplary embodiment, the actuating sleeve 6 is in two parts. It comprises a tubular core 6 and an actuating portion 6' which is applied to the core 6 and consists of plastic. The collar 34 is associated with the core 6.

The annular groove 33 is associated with the tube denoted by reference numeral 7. The circlip 32, which consists of spring steel, is located in this annular groove with radial play. The depth of the annular groove 33 is such that the ring 32 can be completely recessed into it when it is acted on by the boundary edge of the collar 34. This takes place with an audible click. It is then possible to reach the operating position illustrated in FIG. 16, in which the actuating sleeve 6 has displaced the locking sleeve 15 to the rear in such a manner that the blocking ball 14 can move out of the annular neck 31.

Figure 18:
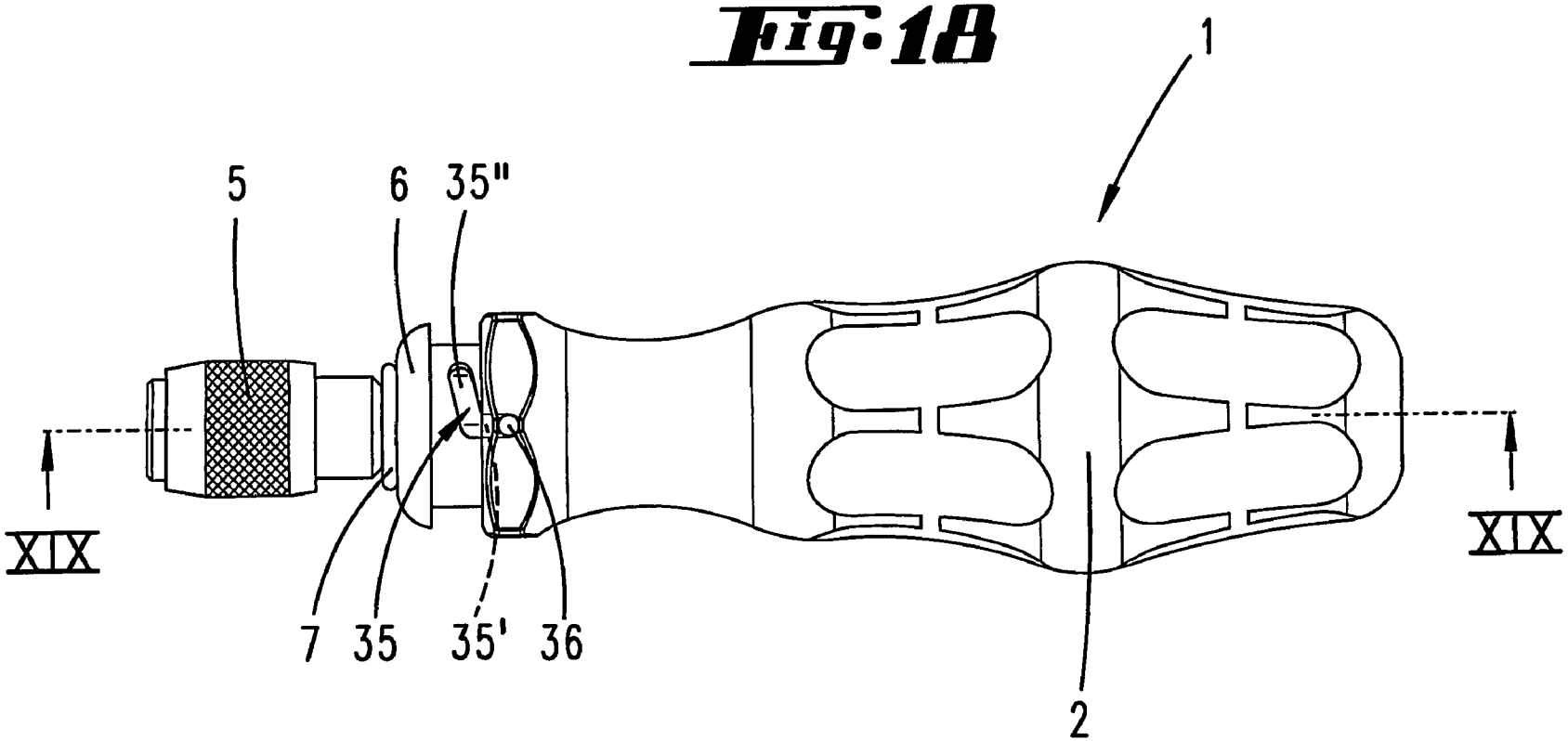
FIG. 18 shows a further exemplary embodiment in plan view.
Figure 19:
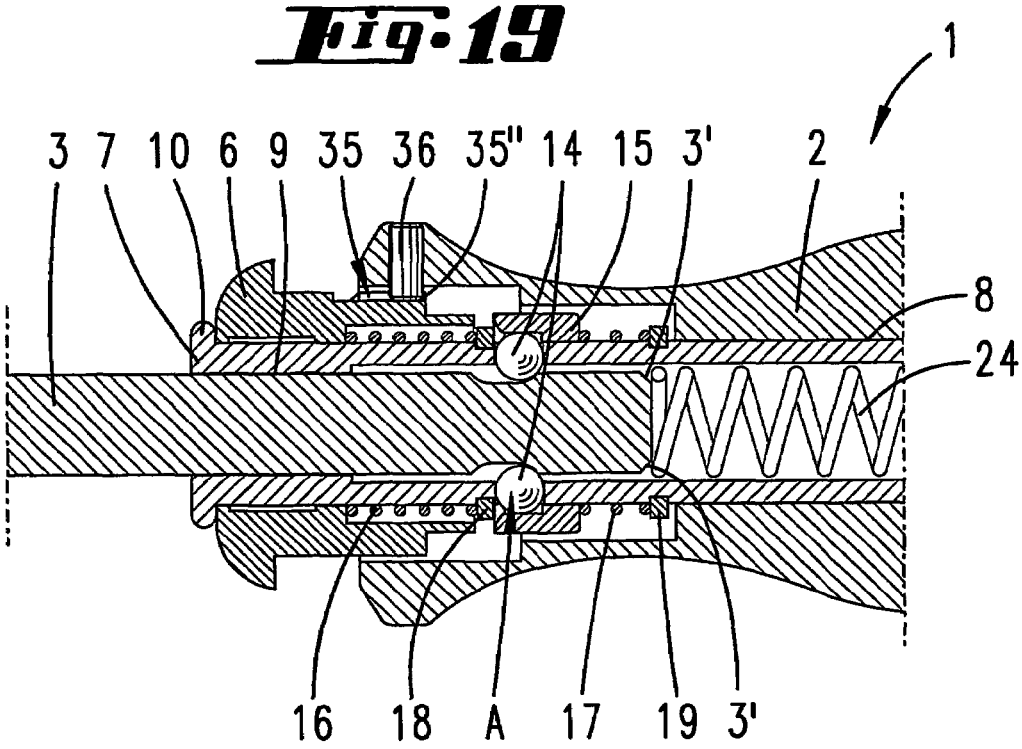
FIG. 19 shows a sectional illustration of the exemplary embodiment in accordance with FIG. 18 with the actuating sleeve locked.
Figure 20:
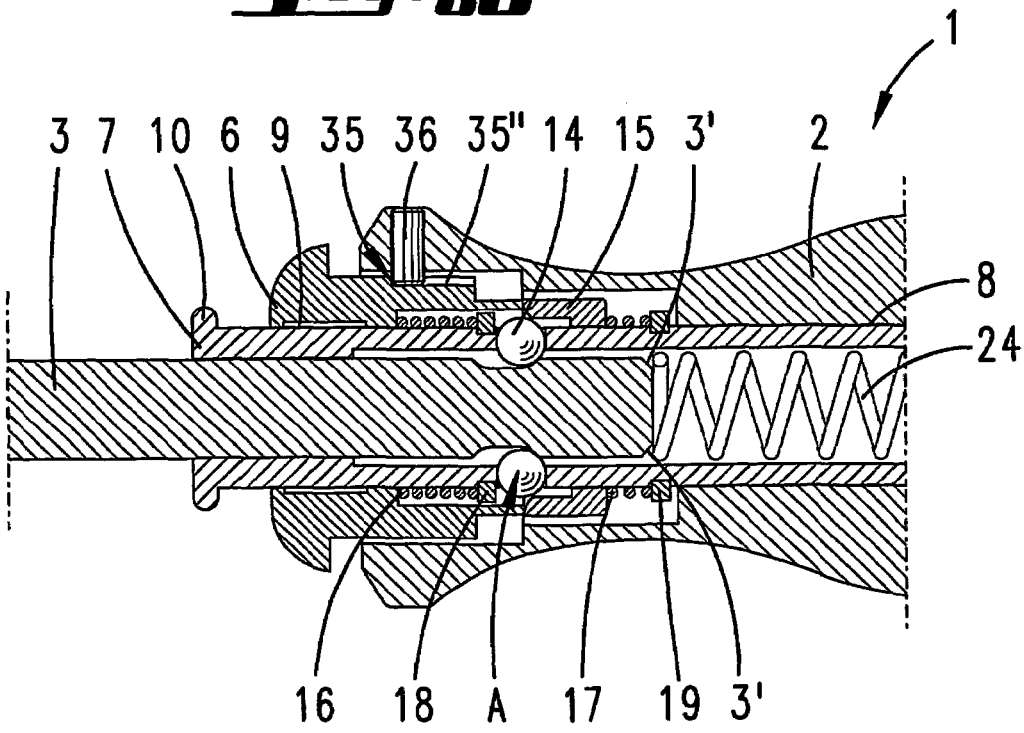
FIG. 20 shows an illustration in accordance with FIG. 19, with the actuating sleeve having been displaced into the release position of the latching ball.
Figure 21:
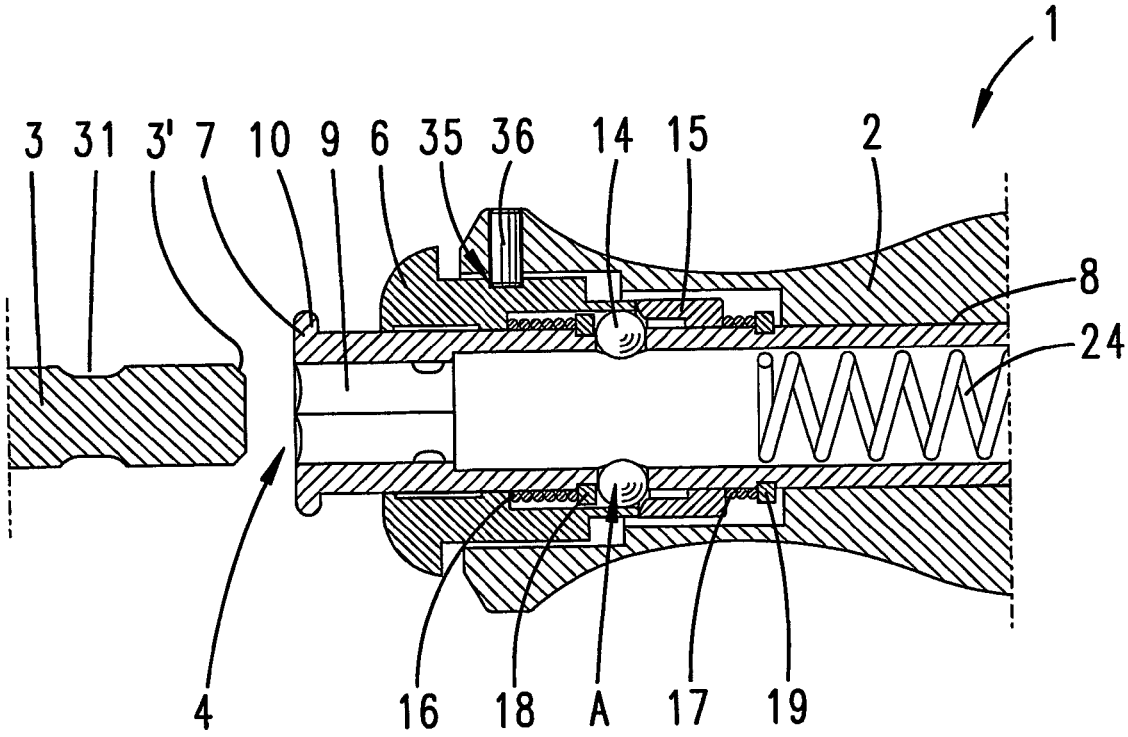
FIG. 21 shows an illustration in accordance with FIG. 19, with the actuating sleeve having been displaced into the release position of the blocking ball.

In the exemplary embodiment illustrated in FIGS. 18 to 20, the actuating sleeve 6, during displacement out of the locking position, encounters a resistance, likewise before the release position of the blocking ball 14 is reached. In this exemplary embodiment, a guide pin 36, which is fixedly connected to the grip, projects into a link guide 35 associated with the actuating sleeve 6. The link guide 35 has a slot portion 35' running in the axial direction and a portion 35" which adjoins the portion 35' at an obtuse angle. During displacement of the actuating sleeve from the locking position into the release position of the latching ball 13, the guide pin 36 slides in the axial slot portion 35'. As a result of subsequent turning of the actuating sleeve, the guide pin 36 moves within the obtuse-angled portion 35' of the link guide 35, with the result that the actuating sleeve 6 is displaced further inward with respect to the grip until it displaces the locking sleeve 15 into the release position of the blocking ball 14.

All features disclosed are (inherently) pertinent to the invention. The disclosure content of the associated/appended priority documents (copy of the prior application) is hereby incorporated in its entirety in the disclosure of the application, partly with a view to incorporating features of these documents in claims of the present application.

The invention claimed is:

1. Screwing tool (1) having a grip (2) with a cavity (4) therein and opening toward an end of the grip (2), and a shank (3), the shank (3) being received removably in the cavity (4) and having a free end which extends from the cavity upon insertion of the shank in the cavity, wherein the shank (3) at its free end has an actuating portion (5); wherein the screwing tool further comprises a retaining element (14) and an actuating member (6) which are components of the grip (2), and wherein then shank (3) is retained in a position of use, with the shank being fixed in terms of rotation on the grip without sliding in an axial direction of the cavity, by means of the retaining element (14); wherein the retaining element (14) is displaced into a removal position by displacement of the actuating member (6) in order for the shank to be removed from the grip (2); in which tool, in a stored position, a large part of the shank (3) is located in the cavity (4), where it is held releasably; wherein the shank, in the stored position, is held by means of releasable holding means (H) of the grip (2) separate from the retaining element (14), it being possible, during release of the holding means, for displacing the shank (3) outwardly from cavity (4) into the position of use onto a stop (A) of the retaining element (14) through the application of force.

2. Screwing tool according to claim 1, wherein the actuating member associated with the grip (2) is displaced into a release position for releasing the holding means (H), and has the form of a sleeve (6).

3. Screwing tool according to claim 2, wherein the stop (A) is formed by the retaining element (14) which can be moved into the removal position by displacement of the actuating sleeve (6) to beyond the release position.

4. Screwing tool according to claim 1, wherein the retaining element (14) which forms the stop (A) can be moved into the removal position by displacement of the actuating member (6) to beyond the release position.

5. Screwing tool according to claim 1, wherein a force required to extend the shank (3) into the position of use is applied by a spring (24), which is stressed as the shank (3) moves into the storage position and is supported against base of the cavity (4).

6. Screwing tool according to claim 1, wherein the stop (A) of the retaining element (14) is formed by at least one blocking ball (14) which enters a blocking recess at the shank end.

7. Screwing tool according to claim 6, wherein a blocking ball of the retaining element (14) is located in a window (12) in the cavity wall and interacts with a locking sleeve (15) which is spring-loaded in the axial direction.

8. Screwing tool according to claim 7, wherein the blocking ball (14), which is located in the window (12) in the storage position, and while the shank (3) is being extended, is spring-loaded in the radial direction by a boundary edge (30) of the locking sleeve (15).

9. Screwing tool according to claim 6, wherein the blocking recess is an annular neck (31) with an axial length which is greater than the diameter of the blocking ball.

10. Screwing tool according to claim 1, wherein the holding means (H) is at least one latching ball (13) which interacts with a corner cutout (29) of the polygonal shank (3).

11. Screwing tool according to claim 10, wherein the latching ball (13) is acted on by an oblique flank (28) of an actuating sleeve (6) which is spring-loaded in the axial direction.

12. Screwing tool according to claim 10, wherein the actuating member (6) has the form of a sleeve, and the latching ball (13), both in the stored position and in the position of use, is located in a corner clearance (29) of the shank (3), to be released by axial displacement of the actuating sleeve (6), in order to axially retain the shank (3).

13. Screwing tool according to claim 12, further comprising a rear stop shoulder (20') of the actuating sleeve (6) which, during axial displacement of the actuating sleeve (6), slides a locking sleeve (15) from its locking position into a release position which allows a blocking ball (14) to be displaced in the radial direction.

14. Screwing tool according to claim 13, wherein the stop shoulder (20') is formed by an annular portion (20) which has a compression spring (16) associated with the actuating sleeve (6), the annular portion engaging over the spring and into a cavity (21) of which the blocking ball (14) can be displaced in the release position.

15. Screwing tool according to claim 7, wherein the locking sleeve (15), in a locking position, is supported against an annular collar (18) which is the abutment for an actuating sleeve spring (16).

16. Screwing tool according to claim 1, wherein the grip cavity (4) is defined by a tube (7) which receives the shank (3) and has a polygonal cavity (9) that provides windows (11, 12) for a blocking ball (14) and a latching ball (13).

17. Screwing tool according to claim 16, wherein the diameter of the latching ball (13) is smaller than the diameter of the blocking ball (14).

18. Screwing tool according to claim 1, wherein the shank (3) can be completely removed from the grip cavity (4) upon deactivation of the stop (A) of the retaining element (14).

19. Screwing tool according to claim 16, wherein the actuating member (6) has the form of an actuating sleeve, and the actuating sleeve (6), as it is being displaced out of its locking position, encounters a perceptible resistance after it has reached a release position of the latching ball (13) but before it has reached a release position of the blocking ball (14).

20. Screwing tool according to claim 19, wherein the resistance is audibly overcome.

21. Screwing tool according to claim 20, wherein the resistance is provided by a collar (34) of the actuating sleeve (6), which collar moves onto a circlip (32) located in a groove (33) in a tube (7) which defines the cavity (4).

22. Screwing tool according to claim 21, wherein the actuating sleeve (6) has to be rotated in order to overcome the resistance.

23. Screwing tool according to claim 21, wherein the tube (7) which defines the cavity (4) forms a connecting link (35) in which a pin (36) engages, the pin being fixed to the grip.

24. Screwing tool according to claim 8, wherein the boundary edge (30) is an inclined boundary edge.

* * * * *